US008466859B1

(12) United States Patent
Herz

(10) Patent No.: US 8,466,859 B1
(45) Date of Patent: Jun. 18, 2013

(54) DISPLAY ILLUMINATION RESPONSE TIME COMPENSATION SYSTEM AND METHOD

(75) Inventor: William Samuel Herz, Hayward, CA (US)

(73) Assignee: Nvidia Corporation, Santa Clara ( * ) Notice: Subject to any disclaimer, the term of this patent is extended or adjusted under 35 U.S.C. 154(b) by 767 days.

(21) Appl. No.: 11/295,941

(22) Filed: Dec. 6, 2005

(51) Int. Cl.
*G09G 3/36* (2006.01)

(52) U.S. Cl.
USPC ..... 345/87; 345/102; 345/204; 345/418

(58) Field of Classification Search
USPC ..... 345/87, 204, 418, 102
See application file for complete search history.

(56) References Cited

U.S. PATENT DOCUMENTS

| | | | | |
|---|---|---|---|---|
| 4,489,318 | A * | 12/1984 | Goldman | 340/5.86 |
| 5,465,102 | A | 11/1995 | Usui et al. | |
| 6,512,537 | B1 * | 1/2003 | Shimizu et al. | 348/155 |
| 7,034,786 | B2 | 4/2006 | Ham | |
| 7,038,647 | B2 | 5/2006 | Shigeta et al. | |
| 7,095,393 | B2 | 8/2006 | Lee | |
| 7,106,287 | B2 | 9/2006 | Ham | |
| 7,148,869 | B2 | 12/2006 | Chen et al. | |
| 7,154,467 | B2 | 12/2006 | Kojima et al. | |
| 7,161,575 | B2 * | 1/2007 | Ham | 345/98 |
| 7,190,340 | B2 | 3/2007 | Sugino | |
| 7,233,699 | B2 * | 6/2007 | Wenzel et al. | 382/209 |
| 7,248,241 | B2 | 7/2007 | Chen et al. | |
| 7,248,242 | B2 | 7/2007 | Chen et al. | |
| 7,362,296 | B2 | 4/2008 | Song et al. | |
| 7,382,349 | B1 * | 6/2008 | Kuhns | 345/102 |
| 8,212,799 | B2 | 7/2012 | Kerwin | |
| 2001/0002833 | A1 * | 6/2001 | Narui | 345/418 |
| 2002/0024481 | A1 | 2/2002 | Kawabe et al. | |
| 2003/0098839 | A1 | 5/2003 | Lee | |
| 2003/0115591 | A1 * | 6/2003 | Weissmueller et al. | 725/22 |
| 2003/0174891 | A1 * | 9/2003 | Wenzel et al. | 382/209 |
| 2003/0183748 | A1 * | 10/2003 | Yamaguchi | 250/208.1 |
| 2004/0027322 | A1 | 2/2004 | Chen et al. | |
| 2004/0041767 | A1 | 3/2004 | Sugino | |
| 2004/0066978 | A1 * | 4/2004 | Nanbu | 382/261 |
| 2004/0175764 | A1 * | 9/2004 | Nishiyama et al. | 435/7.2 |
| 2004/0196274 | A1 | 10/2004 | Song et al. | |
| 2005/0062703 | A1 | 3/2005 | Lee et al. | |
| 2005/0068343 | A1 | 3/2005 | Pan et al. | |
| 2005/0277815 | A1 * | 12/2005 | Taniguchi et al. | 600/300 |
| 2006/0022926 | A1 | 2/2006 | Mizumaki et al. | |
| 2006/0050038 | A1 | 3/2006 | Cheon et al. | |
| 2006/0132491 | A1 * | 6/2006 | Riach et al. | 345/505 |
| 2006/0158416 | A1 | 7/2006 | Ku | |
| 2007/0075951 | A1 | 4/2007 | Lin et al. | |

FOREIGN PATENT DOCUMENTS

| | | |
|---|---|---|
| JP | 2003-36055 | 2/2003 |
| KR | 10-2001-0077568 | 8/2001 |
| KR | 10-2004-0087426 | 10/2004 |

* cited by examiner

*Primary Examiner* — Viet Pham

(57) ABSTRACT

A digital video display response time compensation system and method are presented. A digital video display response time compensation system and method are utilized to direct adjustments in a display presentation. A test pattern response time compensation value determination process for establishing appropriate adjustment levels for a display is performed. A test pattern is displayed; user input on compensation to the test pattern display is received; pixel value calibration settings are determined based upon the user input; and the test pattern display appearance is altered based upon the pixel value calibration settings. After the appropriate pixel illumination adjustment values are establish a pixel value is received. The pixel value is adjusted in accordance with the response time compensation value and a response time compensated pixel value is output.

24 Claims, 4 Drawing Sheets

DISPLAY ILLUMINATION RESPONSE TIME COMPENSATION SYSTEM AND METHOD

FIELD OF THE INVENTION

The present invention relates to the digital video presentations. More particularly the present invention relates to display compensation systems and methods.

BACKGROUND OF THE INVENTION

Electronic systems and circuits have made a significant contribution towards the advancement of modern society and are utilized in a number of applications to achieve advantageous results. Numerous electronic technologies such as digital computers, calculators, audio devices, video equipment, and telephone systems have facilitated increased productivity and reduced costs in analyzing and communicating data, ideas and trends in most areas of business, science, education and entertainment. Frequently, these advantageous results are realized through the use of digital video presentations. The digital video presentations typically provide information in a format that humans typically find easy to observe and digest significant amounts of data in relatively short periods of time. However, digital video presentations can be very complex and often include moving objects which usually involves significant presentation illumination changes. Limitations of display device response characteristics can adversely impact clear and timely presentation of the images.

In most digital video systems an image is presented as a raster (an array) of logical picture elements (pixels). Pixels are usually arranged in a matrix of rows and columns with each pixel having a unique identifier (e.g., row and column indicator). Parameter values are typically assigned to each pixel and the parameter values determine the nature of the rendering on the display screen. The parameter values are digital values that correspond to certain attributes of the image (e.g. color, gamma, depth, etc.) measured over a small area of the image represented by a pixel. Typically, information on the brightness level for each primary color (e.g., red, blue and green) in a pixel is provided for each pixel included in the display. The display "illuminates" each pixel in accordance with illumination data assigned to a corresponding pixel identifier. The pixels are illuminated in a "raster" pattern that usually starts at the top of the display and goes across the display from left to right on each row and then drops to the row below until it reaches the bottom. When the display process gets to the last pixel at the bottom, there is a very short "blank" period for a vertical retrace to return back to the starting pixel at the top of the display.

Numerous different types of display devices are utilized to convey information. Display devices usually generate light by impinging high-energy electrons on a picture element (pixel) of a medium (e.g., liquid crystal, phosphor screen, etc.) that converts the electron energy into visible light utilized to convey images to observers. Despite the differences in the way the high energy beams are impinged on a pixel, the format in which image information is provided to the displays is usually similar and there are typically constraints that impact rendering of an image. For example, graphics image display devices such as a liquid crystal display (LCD) typically take a period of time to respond to pixel information. There is usually a time lag between the receiving the pixel information and a pixel reaching a corresponding appropriate level of illumination.

Typically, the primary function of a display screen is to provide a clear and readily viewable presentation to a user.

However, there are numerous conditions that can have a significant impact on the perceptibility of the presentation. One of the most important factors affecting a users ability to easily perceive the shapes or images of a presentation is appropriate illumination of the display screen. The rate at which images are rendered in typical graphics systems is often critical to proper illumination and presentation of the information. Rapid variances in pixel data associated with moving images can cause distortions and blurriness in object presentation or pixel illumination.

A response time of a display device that is slower than a refresh rate of video pixel information can produce undesirable blurry or inaccurate presentations which usually results in a user experience that is non-immersive and unpleasant. For example, a typical liquid crystal display (LCD) progressive scan rate of 6o Hertz is locked to a rendering rate of 16 mil-seconds and if the response time of the LCD is 20 mil-seconds the display device can not render or display the "new frame" pixel data in time and continues to display the "old frame" pixel data. Thus, some of the pixels in the vicinity of a moving object can be at an old frame value while some are at a new frame value and the presentation of the object is blurred. For example, an image of a blue car moving in front of a red building can produce a frame in which some of the pixels that should be blue and associated with the car are still red and associated with the building resulting in a distortion of the car image with the building image. User's tend to have ever increasing demands for ever more spectacular and clearer images with better resolutions and glitches or delays in image rendering can diminish user experience and/or interaction with a video device.

SUMMARY

A digital video display response time compensation system and method are presented in accordance with embodiments of the present invention. In one embodiment, present invention digital video display response time compensation systems and methods are utilized to reduce adverse presentation impacts associated with lags in digital video displays due to time differences in receipt of content information and actual presentation of the information. The response time compensation can decrease image blurriness. For example, pixel illumination associated with moving objects can be adjusted to provide clearer images.

In one embodiment, a present invention method, a display response time compensation method is utilized to direct adjustments in a display presentation. An iterative test pattern response time compensation value determination process for establishing appropriate adjustment levels for a display is performed. In one embodiment, a test pattern response time compensation value determination process includes displaying a test pattern; receiving user input on compensation to the test pattern display; determining pixel value calibration settings based upon the user input; and altering the test pattern display appearance based upon the pixel value calibration settings. After the appropriate pixel illumination adjustment values are established a pixel value is received. The pixel value is adjusted in accordance with the response time compensation value and a response time compensated pixel value is output.

DESCRIPTION OF THE DRAWINGS

The accompanying drawings, which are incorporated in and form a part of this specification, illustrate embodiments of the invention by way of example and not by way of limitation. The drawings referred to in this specification should be understood as not being drawn to scale except if specifically noted.

DETAILED DESCRIPTION

Figure 1:
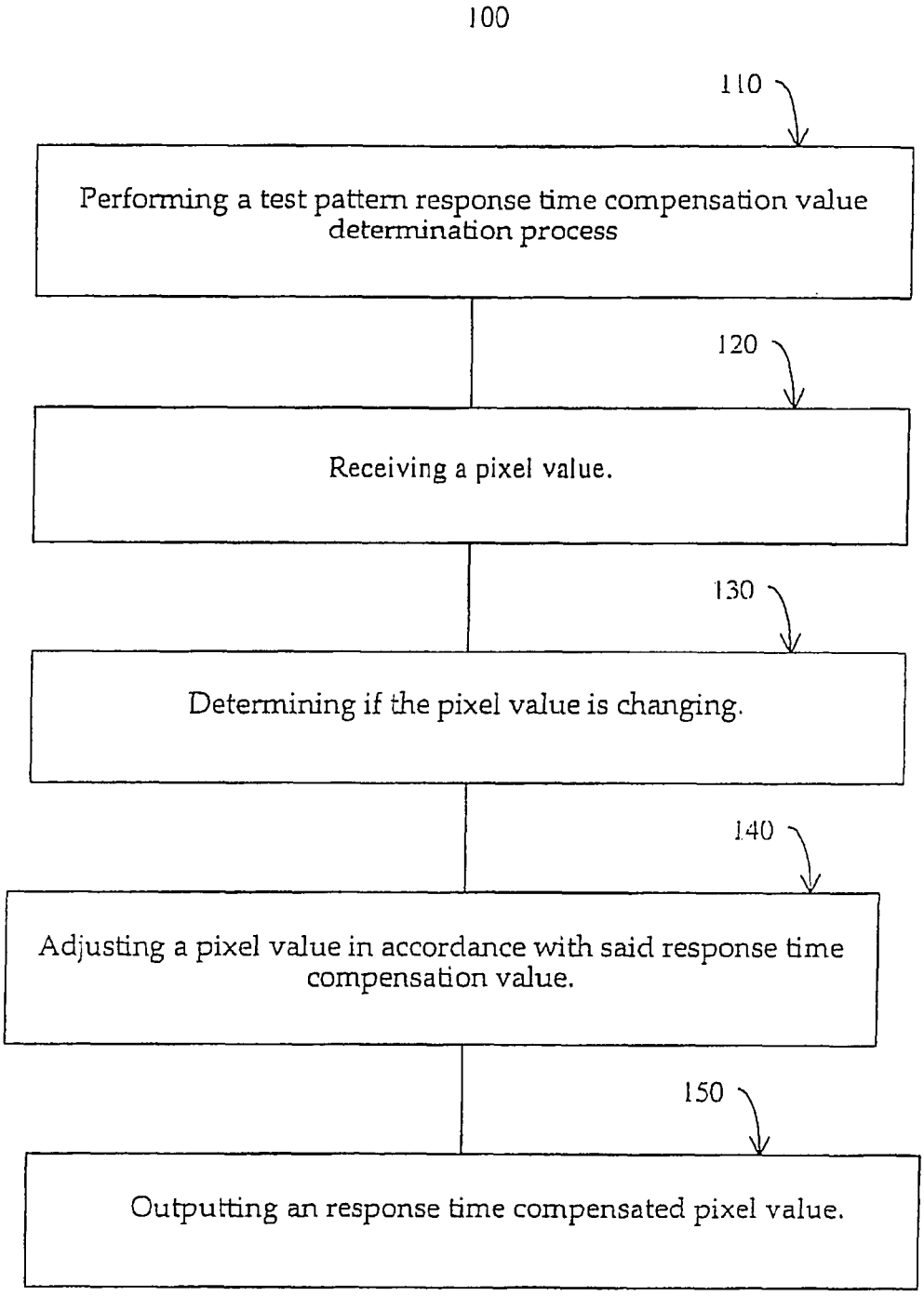
FIG. 1 is a block diagram of an exemplary display response time compensation method in accordance with one embodiment of the present invention.

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Some portions of the detailed descriptions which follow are presented in terms of procedures, logic blocks, processing, and other symbolic representations of operations on data bits within a computer memory. These descriptions and representations are the means generally used by those skilled in data processing arts to effectively convey the substance of their work to others skilled in the art. A procedure, logic block, process, etc., is here, and generally, conceived to be a self-consistent sequence of steps or instructions leading to a desired result. The steps include physical manipulations of physical quantities. Usually, though not necessarily, these quantities take the form of electrical, magnetic, optical, or quantum signals capable of being stored, transferred, combined, compared, and otherwise manipulated in a computer system. It has proven convenient at times, principally for reasons of common usage, to refer to these signals as bits, values, elements, symbols, characters, terms, numbers, or the like.

It should be borne in mind, however, that all of these and similar terms are associated with the appropriate physical quantities and are merely convenient labels applied to these quantities. Unless specifically stated otherwise as apparent from the following discussions, it is appreciated that throughout the present application, discussions utilizing terms such as "processing", "computing", "calculating", "determining", "displaying" or the like, refer to the action and processes of a computer system, or similar processing device (e.g., an electrical, optical, or quantum, computing device), that manipulates and transforms data represented as physical (e.g., electronic) quantities. The terms refer to actions and processes of the processing devices that manipulate or transform physical quantities within a computer system's component (e.g., registers, memories, other such information storage, transmission or display devices, etc.) into other data similarly represented as physical quantities within other components.

Present invention systems and methods facilitate efficient and effective presentation of digital video information. Embodiments of the present invention can facilitate improved clarity and sharpness in digital video presentations. Digital video display systems and methods of the present invention increase pixel illumination coordination with actual content input and effectively reduce perceptual lags (e.g., masks or camouflages the lags) associated with digital video response time delays in a manner that provides improved user experience.

FIG. 1 is an exemplary block diagram of display response time compensation method 100 in accordance with one embodiment of the present invention. Display response time compensation method 100 alters a video content pixel intensity amplitude to a value that drives an actual display response closer to a corresponding appropriate presentation. In one embodiment, display response time compensation method 100 adjusts an illumination amplitude in a manner that effectively reduces (e.g., masks, camouflages, etc,) a response time lag in reaching an actual illumination level that corresponds to a desired video content pixel illumination level.

In step 110, a test pattern response time compensation value determination process is performed. In one embodiment of the present invention the test pattern response time compensation value determination process includes determining a compensation value that reduces noise effects (e.g. speckles, blurriness, etc) on moving images. In one exemplary implementation a test pattern responses from a user are utilized to establish response time compensation values.

In step 120, a pixel value is received. The pixel value is a value corresponding to a desired actual content presentation. The pixel value can include parameter values assigned to the pixel and the parameter values determine the nature of the projection on a display screen. The parameter values are digital values that correspond to certain attributes of the image and include illumination intensity levels for each primary color (e.g., red, blue and green). It is appreciated that a pixel value can be received from a variety of graphics applications.

In step 130, a determination is made if the pixel value is changing. In one embodiment, the determination is made if the pixel is associated with a presentation related to a moving object. For example, geometrically analysis including velocity vector examination can be utilized to determine if an object is moving or stationary. In one exemplary implementation a motion detection algorithm determines a rate at which a scene is changing. For example, the motion detection algorithm can distinguish if a first scene includes a fast moving image and a second scene includes a slower moving image. The relative rate at which a scene is changing can be utilized in determining whether an adjustment is linear or nonlinear.

In one embodiment, the present invention also detects pixel values that are static. For example, pixels that are associated with an object that is not moving are identified. In one exemplary implementation, a determination is made if a scene is in a pause mode and the pixels values should not change (e.g., no adjustments associated with response time compensation). If a scene is not changing historical data can be reset and compensation turned off. After historical data is reset and compensation turned off the process can start over.

In step 140, pixel values that are changing are adjusted in accordance with the response time compensation value. In one embodiment, the adjustment includes a pre-emphasis change in which the intensity of amplitude of a pixel illumination is increased. The adjustment can also include a de-emphasis change in which the intensity or illumination of a pixel is decreased. The decision of whether to pre-emphasize or de-emphasize can be based on the "content" or pixel values getting brighter or darker (e.g., higher or lower pixel values). The decision to pre-emphasize or de-emphasize can also be based upon an evaluation of the degree of change in the "content" or pixels values. The adjustments can include piecewise functions that include increasing pre-emphasis or decreasing de-emphasis changes in which one zone of interest is adjusted non-linearly and another zone of interest is adjusted linearly. Zones of interest can be distinguished based upon the rate at which the pixel values are changing associated with the rate at which an image is moving per user preference. For example, if the rate at which pixel values are changing is slow (e.g., associated with a slow moving image) a linear emphasis adjustment can be made to the pixel values. If the rate at which pixel values are changing is fast (e.g., associated with a fast moving image) a non-linear emphasis adjustment can be made to the pixel value separating the treatment of fast changing pixels vs. slower changing pixels relative to the characteristics of the given display's response time. The adjusting can include references to a subsequent pixel value to determine appropriate lead adjustments. Display response time compensation adjustments in the pixel value are not made if the pixel value is associated with a static image pixel.

In step 150 a response time compensated pixel value is output. In one embodiment of the present invention, the response time compensated pixel value is output to a display medium (e.g., a screen) for presentation. In one exemplary implementation, the response time compensated pixel value is the illumination value actually fed into the electron emitting component of a display.

In one embodiment of the present invention, a display time response compensation system adjusts display illumination values to compensate for response time impacts. In one exemplary implementation, the display time response compensation system includes a processor, a memory and a bus for communicating information between the processor and memory. The processor performs display response compensation instructions. The memory stores the display response compensation instructions. The display response compensation instructions include instructions for establishing response time compensation values based upon test pattern responses and calibrating pixel values in accordance with the response time compensation values. The calibrating can include geometrical analysis of a moving object vector trajectory. A movement threshold analysis can be utilized in one exemplary implementation. The processor can utilize non-linearly amplitude modification based upon historical pixel data to achieve calibration of the pixel values. The system can also include a duel head component for presenting a correct rendering of a test pattern while permitting matching with a display rendered version. For example, the system can include a first screen showing what the presentation should look like and a second screen showing a simulation or actual LCD display of this processing.

Figure 2:
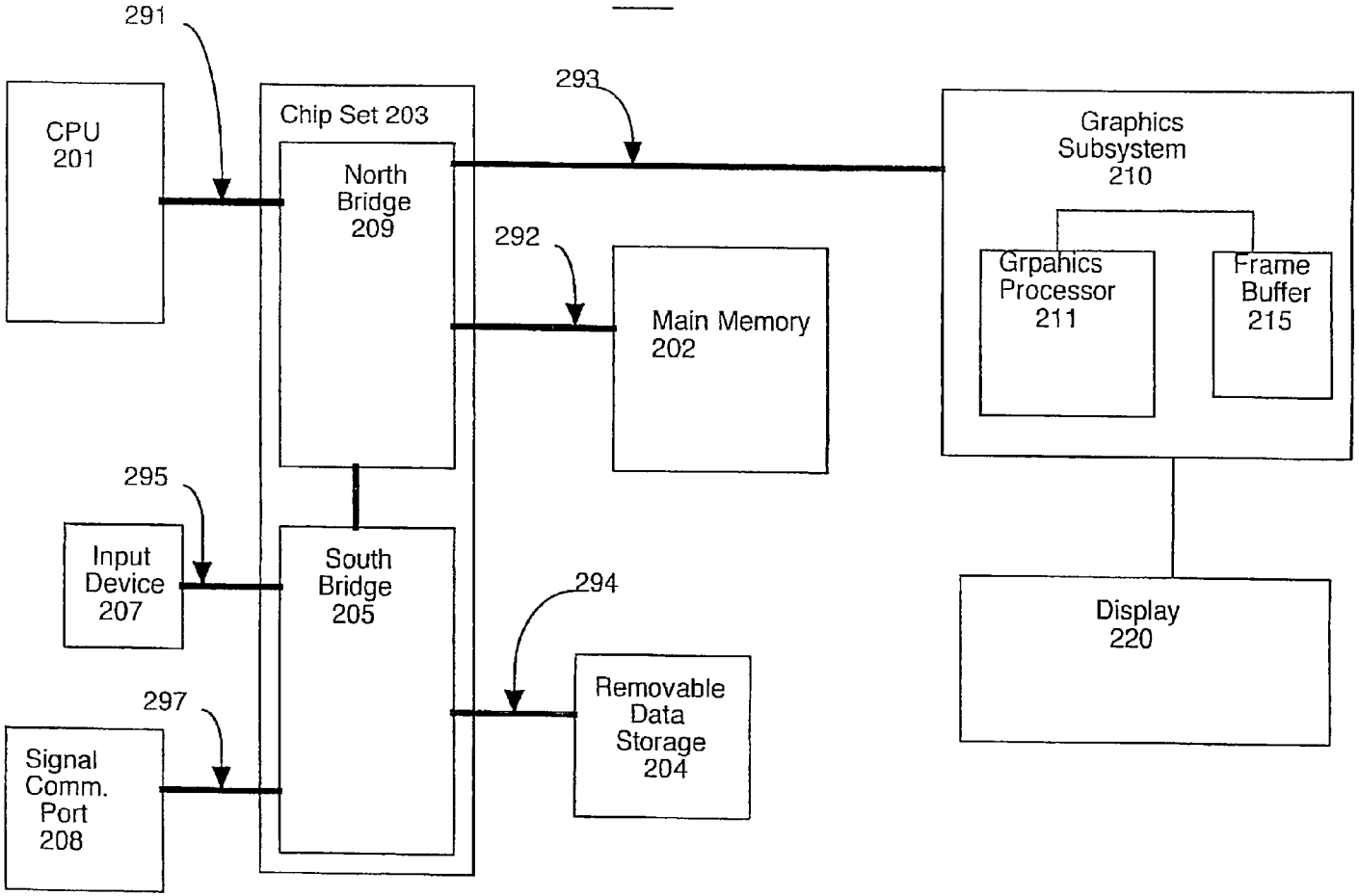
FIG. 2 is a block diagram of an exemplary display time response compensation system, one embodiment of a computer system upon which embodiments of the present invention can be implemented.

FIG. 2 is a block diagram of display time response compensation system 200, one embodiment of a computer system upon which embodiments of the present invention can be implemented. Computer system 200 includes central processor unit 201, main memory 202 (e.g., random access memory), chip set 203 with north bridge 209 and south bridge 205, removable data storage device 204, input device 207, signal communications port 208, and graphics subsystem 210 which is coupled to display 220. Computer system 200 includes several busses for communicatively coupling the components of computer system 200. Communication bus 291 (e.g., a front side bus) couples north bridge 209 of chipset 203 to central processor unit 201. Communication bus 292 (e.g., a main memory bus) couples north bridge 209 of chipset 203 to main memory 202. Communication bus 293 (e.g., the Advanced Graphics Port interface) couples north bridge 209 of chipset 203 to graphic subsystem 210. Communication buses 294-297 (e.g., a PCI bus) couple south bridge 205 of chip set 203 to removable data storage device 204, input device 207, and signal communications port 208 respectively. Graphics subsystem 210 includes graphics processor 211 and graphics buffer 215.

The components of computer system 200 cooperatively operate to provide presentations of graphics images. Communications bus 291 through 297 communicate information. Central processor 201 processes information. Main memory 202 stores information and instructions for the central processor 201. Removable data storage device 204 also stores information and instructions (e.g., functioning as a large information reservoir). Input device 207 provides a mechanism for inputting information and/or for pointing to or highlighting information on display 220. Signal communication port 208 provides a communication interface to exterior devices (e.g., an interface with a network). Display device 220 displays information in accordance with data stored in frame buffer 215. Graphics processor 211 processes graphics commands from central processor 201 and provides the resulting data to graphics buffer 215 for storage and retrieval by display monitor 220. Graphics processor 211 can also execute display response compensation instructions. In one exemplary implementation the display response compensation instructions include establishing response time compensation values based upon test results calibrating pixel values in accordance with said response time compensation values.

Figure 3:
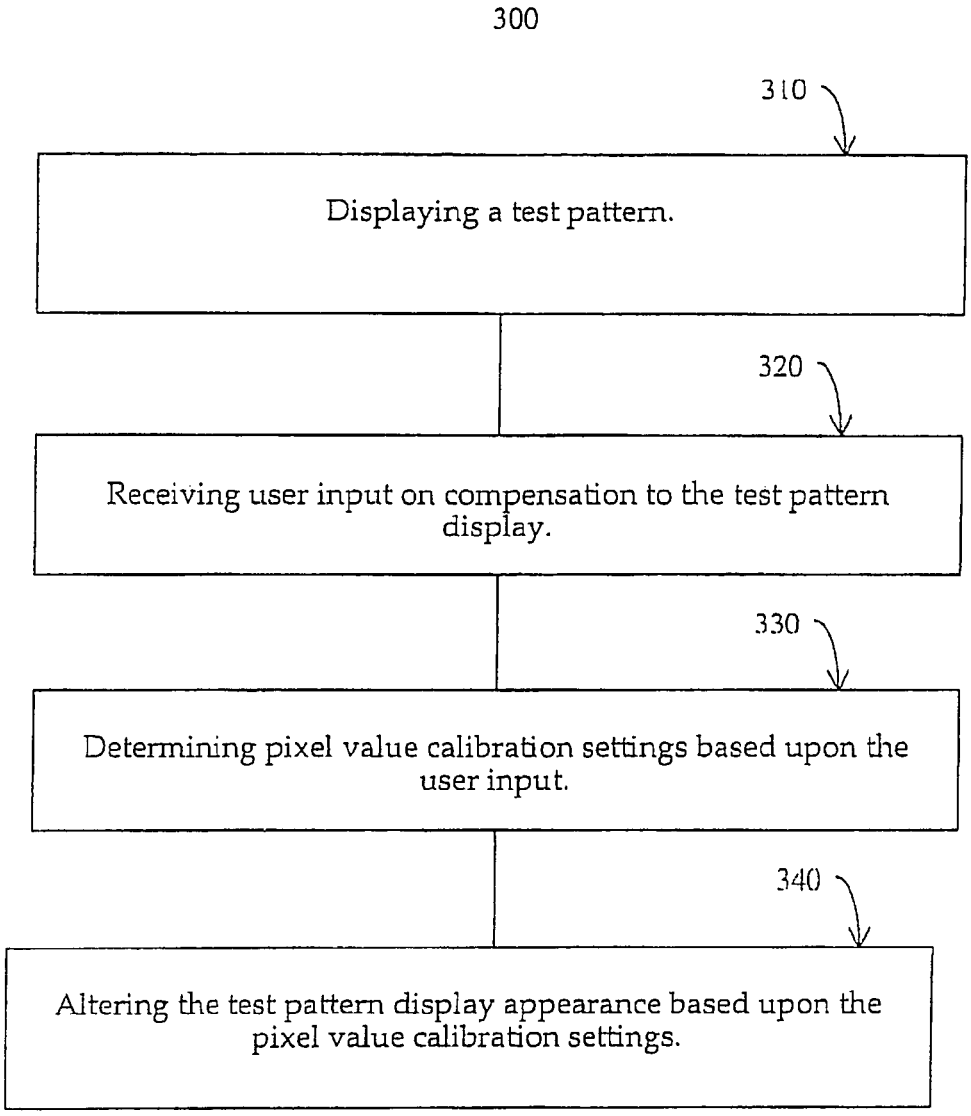
FIG. 3 is a flow chart of an exemplary test pattern response time compensation value determination process in accordance with one embodiment of the present invention.

FIG. 3 is a flow chart of test pattern response time compensation value determination process 300 in accordance with one embodiment of the present invention. Test pattern response time compensation value determination process 300 facilitates determination of appropriate response time illumination compensation values.

In step 310, a test pattern is displayed. The test pattern can be any sequence that simulates presentation amplitude transition values that are likely to appear in motion video content. In one embodiment of the present invention, a test pattern includes changing pixel values. For example, an image of a moving object can be displayed. Test patterns can be presented in which the velocity of the image can change or remain constant. In one exemplary implementation, the test pattern is initially displayed without a response time compensation adjustment.

In step 320, input on compensation to the test pattern display is received. In one embodiment, the input is received from a user viewing the test pattern displayed in step 310. In one exemplary implementation, a user control panel is presented for receiving user input on test pattern display. The user control panel can be a graphical user interface with an adjustment indicator. The adjustment indicator can include a graphical icon (e.g., a button, knob, slider, etc.) which permits a user to adjust pixel compensation values on a test pattern.

In step 330, pixel value calibration settings are determined based upon the user input. The input can include a desired amount of increase or decrease in a pixel illumination value. The input can be expressed in absolute adjustment terms and/or a percentage with respect to the received video content value. If a user indicates the illumination values should increase or decrease, a determination is made of the amount of adjustment appropriate to reach the desired illumination level. The pixel value calibration settings are stored in an order organized for correlated retrieval. In one embodiment of the pixel value calibration settings are stored in a lookup table. In one exemplary implementation, the pixel value calibration settings are tuned to geometries and differences that a user's eye is sensitive to.

In step 340, the test pattern display appearance is altered based upon the pixel value calibration settings. In one embodiment, the test pattern is displayed again with adjustments to pixel illumination levels and additional user input can be received. In one embodiment, test pattern response time compensation value determination process 300 is an iterative process in which a user again inputs further adjustments indications which are implemented and presented to the user again. The iterative process continues until the user is satisfied the adjustments are providing a sharper image. The iterative process can cover both low to high amplitude and high to low amplitude.

Figure 4:
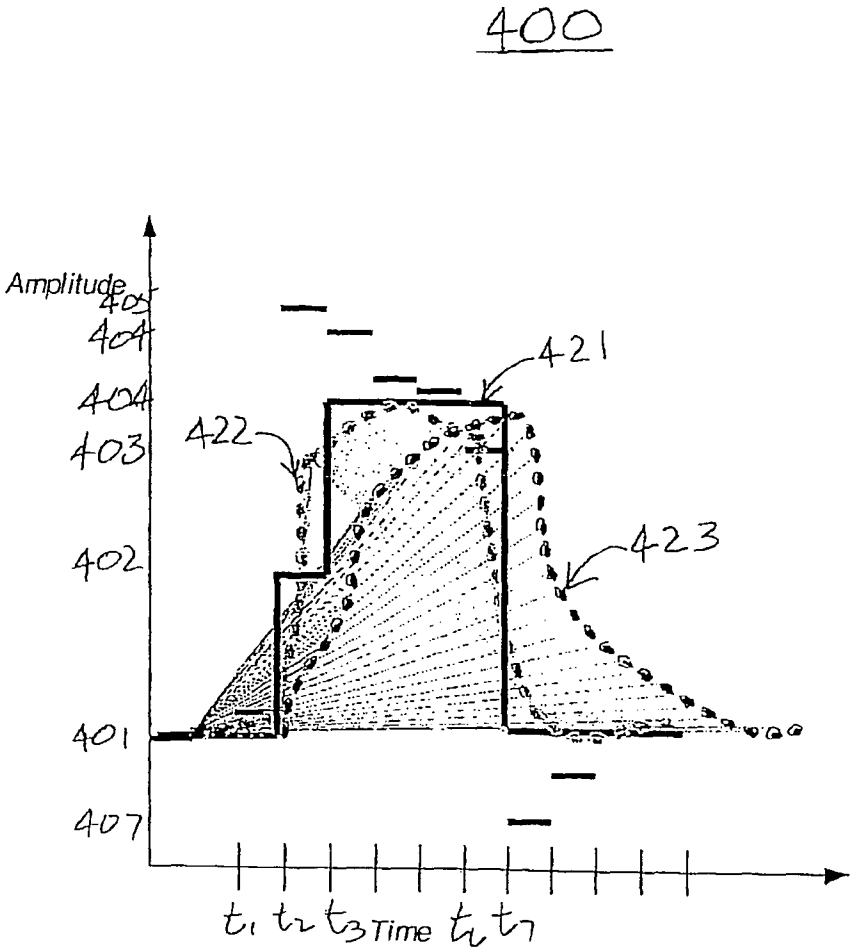
FIG. 4 is an exemplary video display response time compensation graph illustrating pixel illumination levels in accordance with one embodiment of the present invention.

FIG. 4 is an exemplary video display response time compensation graph 400 in accordance with one embodiment of the present invention. Video display response time compensation graph 400 illustrates changes in a pixel presentation. Amplitude of pixel illumination is shown on the Y-axis and time is shown on the X-axis. Line 421 shows the video content input values. Line 423 shows the response of a display without present invention response time compensation adjustments. Line 422 shows the response of the display with present invention response time compensation adjustments.

The received video content illumination level pattern shown by line 421 is the desired presentation illumination levels. At time t1 the desired pixel illumination level is 401, at time t2 the desired pixel illumination level is 402, and at time t3 the desired pixel illumination level is 404. Line 423 illustrates that without the present invention the normal actual pixel illumination value presentation lags behind the desired pixel illumination level. For example, at time t2 the normal actual pixel illumination value has not reached desired value of 402 and does not reach the desired value until after time t3. This delay is due to the normal response time lag in the display. However, with the present invention in which the pixel value is adjusted up to the 405 pixel illumination value, line 422 illustrates that the actual presentation value is very close to the desired illumination value at t2. Similarly, when a pixel value is adjusted up to the 404 pixel illumination value, line 422 illustrates that the actual presentation value is very close to the desired illumination value at t3.

It is appreciated that the present invention adjustments can be made for increasing and decreasing pixel illumination values. For example, desired input content value is adjusted down to pixel illumination value 403 and 407, line 422 is very close to the desired illumination value at t6 and t7 respectively. Overall exemplary video display response time compensation graph 400 illustrates that pixel illumination adjusted in accordance with the present invention produce an actual pixel illumination output line 422 that is closer to the desired line 421 than an actual pixel illumination output line 423 without the present invention.

Thus, the present invention facilitates improved digital video display presentations. Actual pixel presentation changes are closer to desired pixel presentation changes and displayed in a timely manner. Blurriness associated with moving objects is reduced. Images are sharper and provide for an improved user experience.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A display response time compensation method comprising:

performing in an electronic system a test pattern response time compensation value determination process, wherein said performing comprises receiving input about a test pattern display via a graphical user interface that comprises an adjustment indicator;

receiving a pixel value;

adjusting said pixel value in said electronic system in accordance with said response time compensation value, wherein an adjustment is linear in a first zone of interest and non-linear in a second zone of interest, wherein said first zone of interest and said second zone of interest can be distinguished based upon the rate at which pixel values are changing associated with a rate at which an image is moving; and outputting a response time compensated pixel value.

2. The display response time compensation method of claim 1 wherein said adjusting includes a piecewise increasing pre-emphasis change in which one of said first zone of interest and said second zone of interest is adjusted non-linearly.

3. The display response time compensation method of claim 1 wherein said adjusting includes a piecewise decreasing de-emphasis change in which one of said first zone of interest and said second zone of interest is adjusted non-linearly.

4. The display response time compensation method of claim 1 wherein said adjusting includes reference to a subsequent frame's pixel values.

5. The display response time compensation method of claim 1 further comprising:

determining in said electronic system if said received pixel value is associated with a pixel that is changing values between frames; and ceasing adjustments in said pixel value if said pixel value is associated with a static image pixel.

6. The display response time compensation method of claim 1 further comprising detecting in said electronic system a static image frame associated with a paused mode.

7. The display response time compensation method of claim 6 further comprising ceasing adjustments in said pixel value if said pixel value is associated with said paused mode.

8. A display time response compensation system comprising:

a bus for communicating information;

a processor for performing display response compensation instructions, said processor communicatively coupled to said bus; and a memory for storing said display response compensation instructions, said memory communicatively coupled to said bus, wherein said display response compensation instructions include:

establishing response time compensation values based upon user subjective test results, wherein said establishing comprises receiving input about a test pattern display a graphical user interface that comprises an adjustment indicator, wherein said response time compensation values are linear in a first zone of interest and non-linear in a second zone of interest, wherein said first zone of interest and said second zone of interest can be distinguished based upon the rate at which pixel values are changing associated with a rate at which an image is moving; and calibrating pixel values in accordance with said response time compensation values.

9. The display time response compensation system of claim 8 wherein said calibrating includes geometrical analysis of a moving object vector trajectory.

10. The display time response compensation system of claim 8 wherein said instructions include a movement threshold analysis.

11. The display time response compensation system of claim 8 wherein said processor utilizes non-linearly introduced amplitude modification based upon historical pixel data to achieve calibration of said pixel values.

12. The display time response compensation system of claim 8 wherein said instructions include resetting historical data and turning off compensation if no image motion is detected.

13. The display time response compensation system of claim 8 further comprising a dual head component for presenting a correct rendering of a test pattern while permitting matching with a display rendered version.

14. The display time response compensation system of claim 8 wherein said processor is a graphics processing unit including pixel shaders.

15. The display time response compensation system of claim 8 wherein said processor is a graphics processing unit including a dedicated video processor.

16. The display time response compensation system of claim 8 wherein said processor is a programmable function processing engine.

17. A test pattern response time compensation value determination process comprising:

displaying a test pattern;

receiving user input via a graphical user interface on compensation to said test pattern display, wherein said graphical user interface comprises an adjustment indicator to adjust said compensation, wherein an adjustment is linear in a first zone of interest and non-linear in a second zone of interest, wherein said first zone of interest and said second zone of interest can be distinguished based upon the rate at which pixel values are changing associated with a rate at which an image is moving;

determining in an electronic system pixel value calibration settings based upon said user input; and altering said test pattern display appearance in said electronic system based upon said pixel value calibration settings.

18. The test pattern response time compensation value determination process of claim 17 wherein said pixel value calibration settings are stored.

19. The test pattern response time compensation value determination process of claim 17 wherein said pixel value calibration settings corresponding to subjective user input are stored in a lookup table.

20. The test pattern response time compensation value determination process of claim 19 wherein pixel changing conditions are fed into said lookup table as index values that correspond to user input value adjustments which are utilized to provide pixel compensation.

21. The test pattern response time compensation value determination process of claim 17 wherein said graphical user interface is a user control panel for receiving user input on test pattern display.

22. The test pattern response time compensation value determination process of claim 17 wherein a determination is made of the amount of adjustment appropriate to reach a desired illumination level.

23. The test pattern response time compensation value termination process of claim 17 wherein said test pattern includes changing pixel values.

24. The test pattern response time compensation value determination process of claim 17 wherein test patterns are presented in which the velocity of the image can change or remain constant.

* * * * *